US006082421A

United States Patent [19]

Nicol et al.

[11] Patent Number: 6,082,421

[45] Date of Patent: Jul. 4, 2000

[54] FINGER JOINTER

[75] Inventors: Richard J. Nicol, Eugene; Brock E. Ferguson, Cottage Grove; Kenneth D. Shoemaker, Eugene, all of Oreg.

[73] Assignee: Western Pneumatics, Inc., Eugene, Oreg.

[21] Appl. No.: 09/089,047

[22] Filed: Jun. 2, 1998

[51] Int. Cl.[7] ..... B27M 1/00

[52] U.S. Cl. ..... 144/90.1; 144/91; 144/245.1; 144/245.2; 144/347; 198/744; 198/817

[58] Field of Search ..... 198/411, 740, 198/744, 817, 434; 144/4.2, 3.1, 90.1, 91, 91.2, 347, 356, 357, 242.1, 245.1, 245.2, 245.4, 250.22

[56] References Cited

U.S. PATENT DOCUMENTS 2,868,249 1/1959 Taylor et al. .
3,527,274 9/1970 Kramer et al. .
3,927,705 12/1975 Cromeens et al. .
4,128,119 12/1978 Maier .
4,196,760 4/1980 McDaniel et al. .
4,246,943 1/1981 Cromeens .
4,429,784 2/1984 Croomens .
4,941,521 7/1990 Redekop et al. .
5,617,910 4/1997 Hill .

*Primary Examiner*—W. Donald Bray
*Attorney, Agent, or Firm*—Kolisch Hartwell Dickinson McCormack & Heuser

[57] ABSTRACT

An automated finger jointer for milling finger joint profiles into the ends of short blocks of wood, assembling the blocks and compressing the blocks together to provide a long pieces of wood.

17 Claims, 11 Drawing Sheets

FINGER JOINTER

FIELD OF THE INVENTION

This invention relates generally to automated finger jointing machines and more particularly to an economical automated finger jointer.

BACKGROUND OF THE INVENTION

Increasing environmental restrictions on logging and diminishing supplies of high quality old growth timber have led to dramatic escalation in the cost of lumber. In particular, clear lumber, i.e., lumber that is free of knots or other defects, has become especially valuable. Because of the increasing cost of natural clear lumber, it is desirable to provide a substitute product formed from lower cost raw material such as low grade lumber, i.e., lumber with knots, cracks or other defects. It is also desirable to recover useful lumber from the short pieces of lumber that are offal from various lumber processing operations and which would otherwise go to waste.

One way to create a long piece of clear lumber is to join small clear pieces together, usually with a joint called a finger joint. This is accomplished by taking short clear blocks from longer pieces of low grade lumber or offal and joining those blocks together. The use of finger joints in the assembly of the composite board results in a product that has nearly the same strength as a naturally occurring clear board. This allows lumber that is otherwise only suitable for low value uses to be converted to high value clear lumber.

Small pieces or blocks of wood are normally joined together with the aid of a finger jointing machine. The finger jointing machine mills or cuts fingers into each end of the blocks, applies glue to one or both ends and presses the blocks together so that the fingers on each block interlock, thus forming the final product. Most typically, the blocks are carried through the finger jointing machine on a conveyor that has a number of spaced apart lugs. The boards are placed in a spaced apart side-by-side arrangement, one in front of each lug, and the lugs carry or push the boards through the machine.

It is important that the finger jointing machine be capable of working with blocks of varying length to obtain the highest recovery of clear product from low grade source lumber. Existing finger jointing machines can typically mill and press together blocks ranging from 4" in length up to blocks 36" or longer. To avoid the additional step of sorting the short clear blocks into groups of uniform length, the machines are designed to accommodate blocks of assorted lengths in random order, within the above range. Thus, a 4" block may directly follow a 30" block, which may in turn be followed by a 16" block. Generally a single sequence of blocks will have the same thickness and width, but a finger jointing machine can usually be set to accept various thicknesses or widths of blocks by some adjustment or modification.

Unfortunately, although existing automated finger jointers are effective for carrying out the process of finger jointing, they are so complex and expensive as to preclude their use in smaller facilities with lower production requirements. As a result, many wood working facilities which might have a need for recycling a limited supply of short wood blocks have been unable to justify the substantial cost of existing automated finger jointers.

DETAILED DESCRIPTION AND BEST MODE OF CARRYING OUT THE INVENTION

Figure 1:
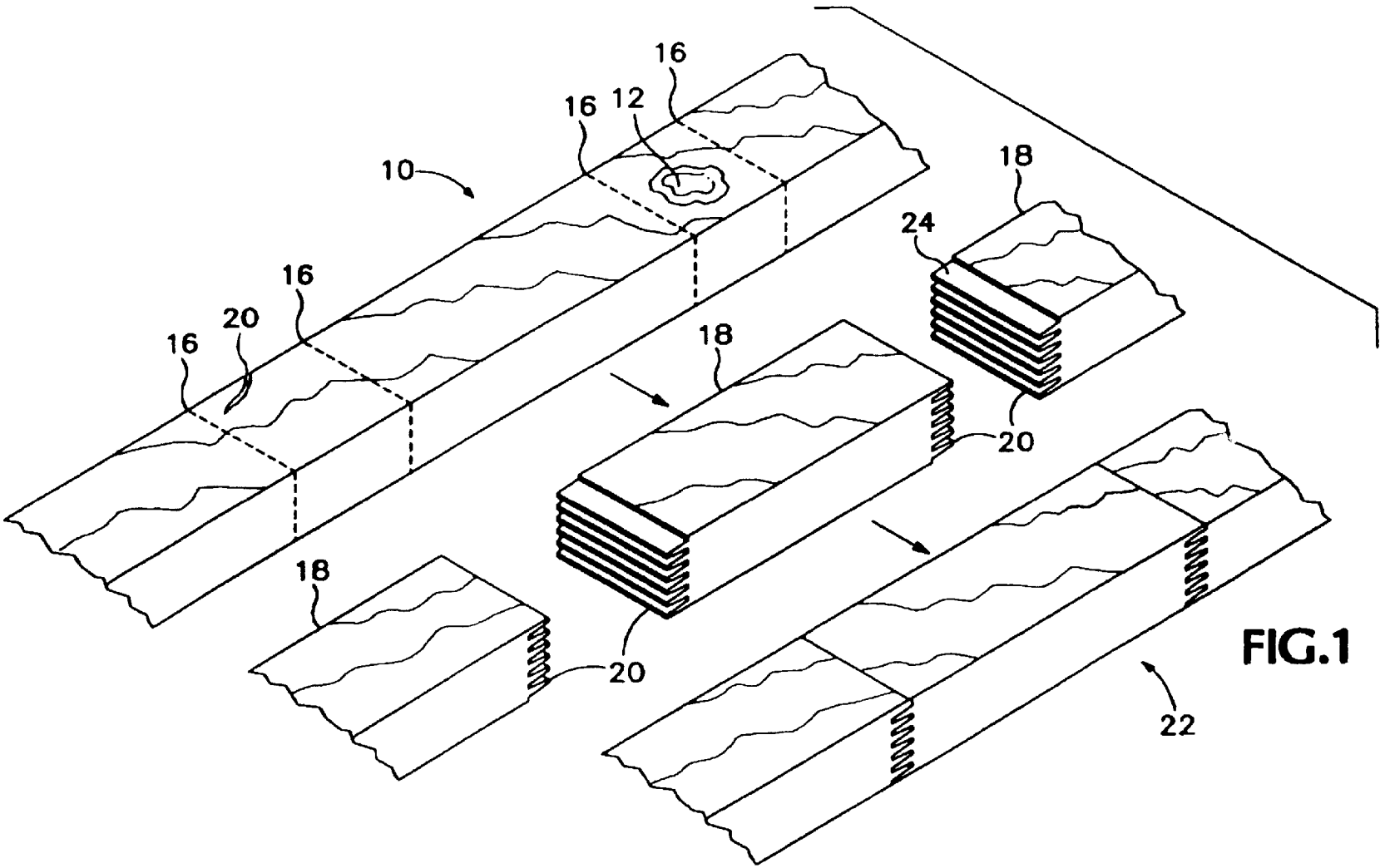
FIG. 1 shows the process of forming a long clear board from a piece of low grade lumber by joining several short blocks together with finger joints.
Figure 2:
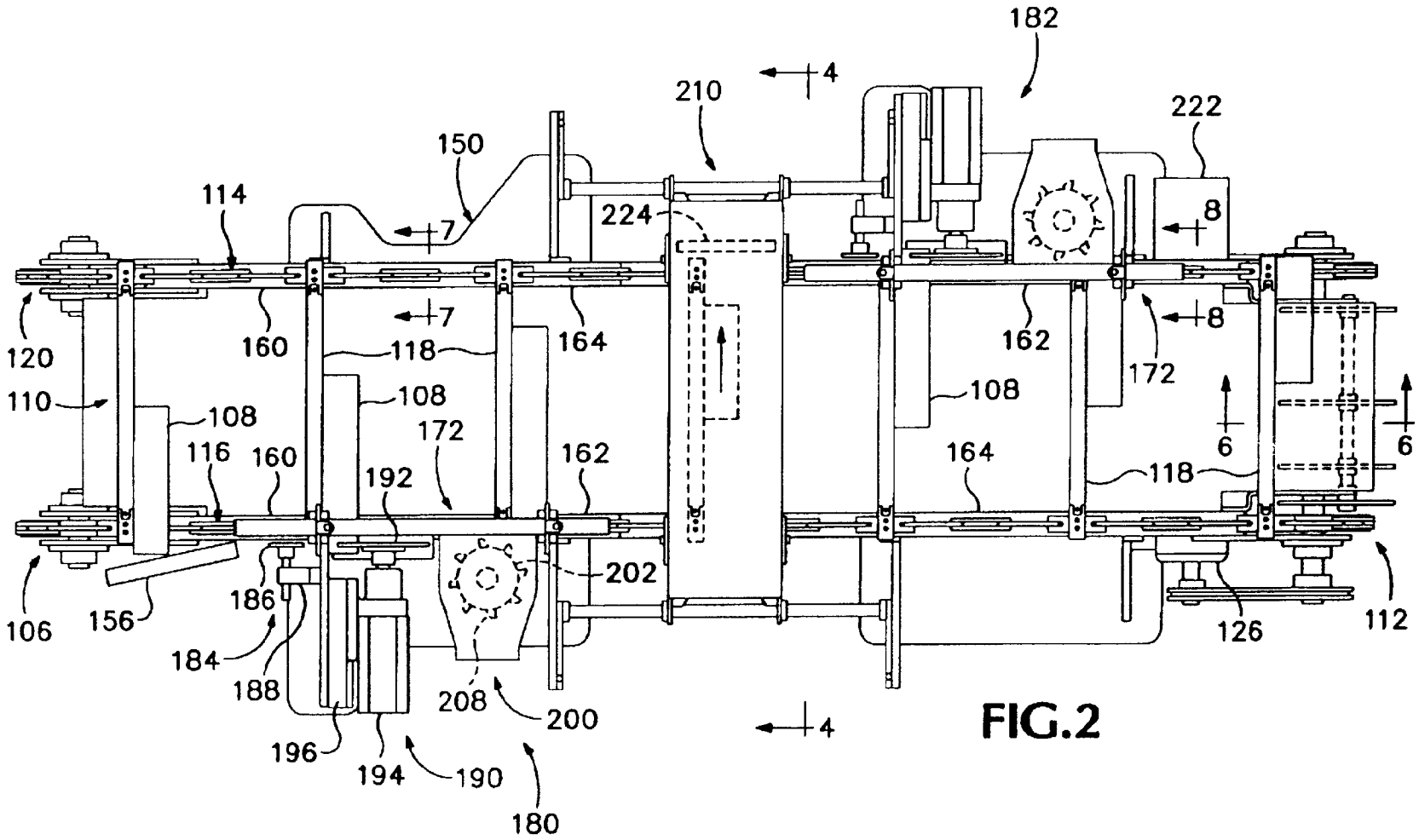
FIG. 2 is a plan view of a profiling section of a finger jointer constructed according to the present invention.
Figure 3:
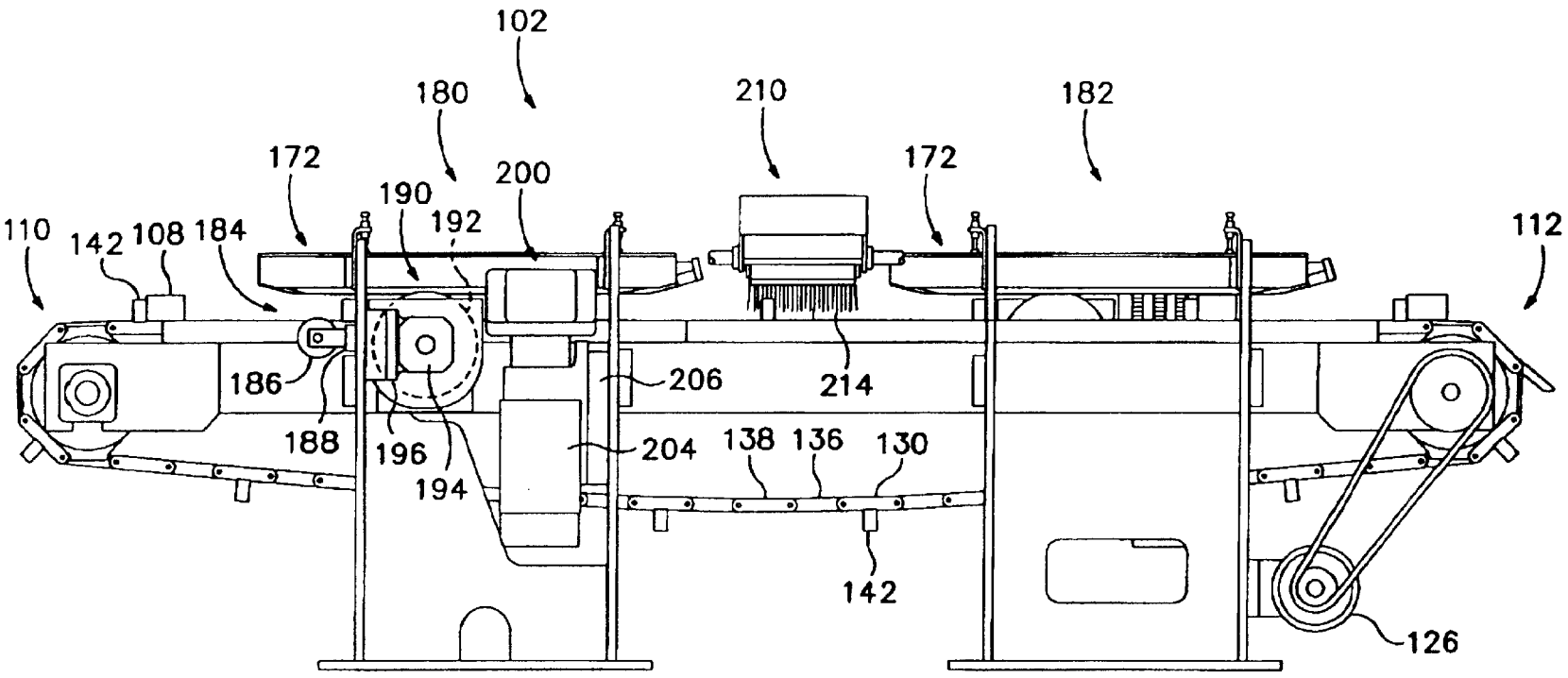
FIG. 3 is an elevation view of the profiling section.
Figure 4:
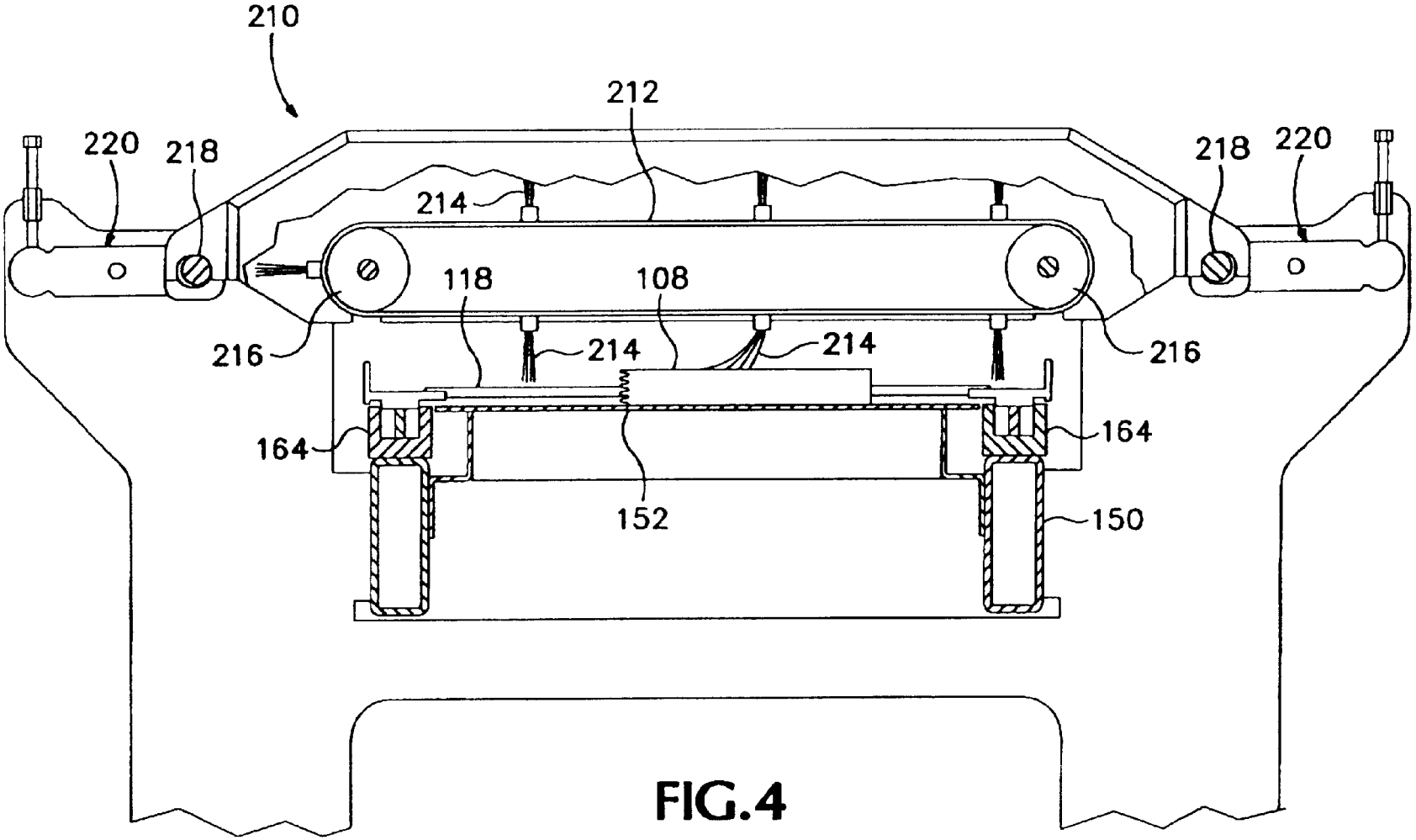
FIG. 4 is a sectional view through the profiling section along line 4—4 in FIG. 2.
Figure 5:
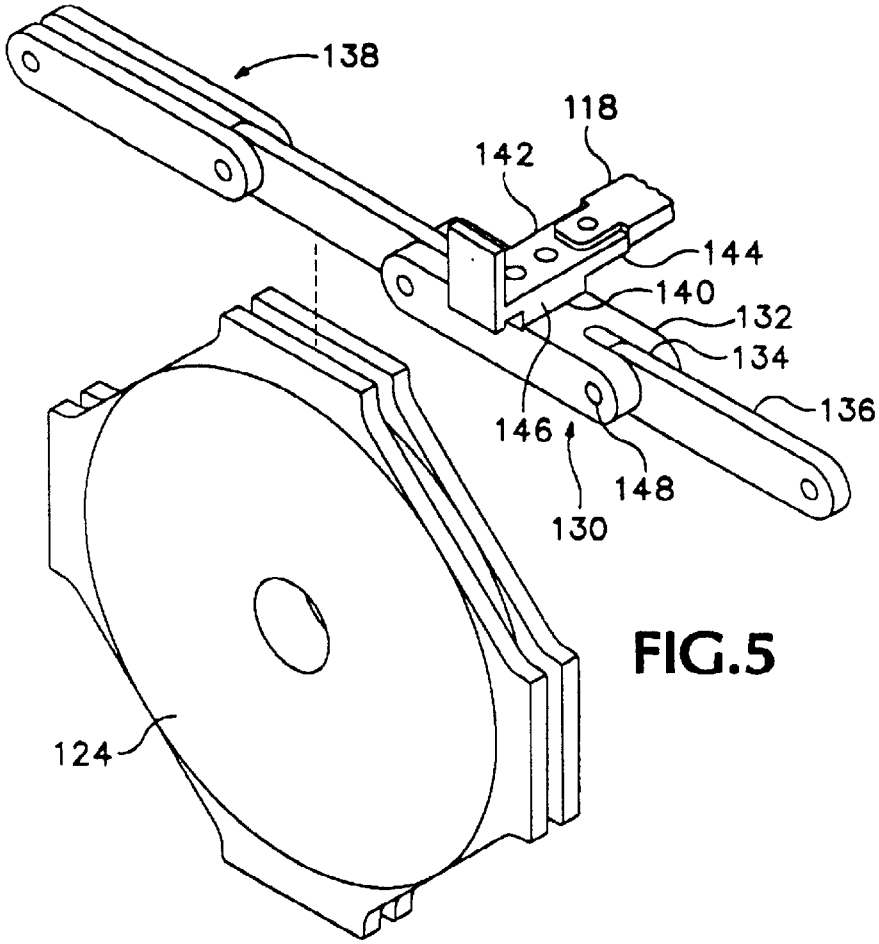
FIG. 5 is a perspective view of a sprocket and lug chain according to the present invention.
Figure 6:
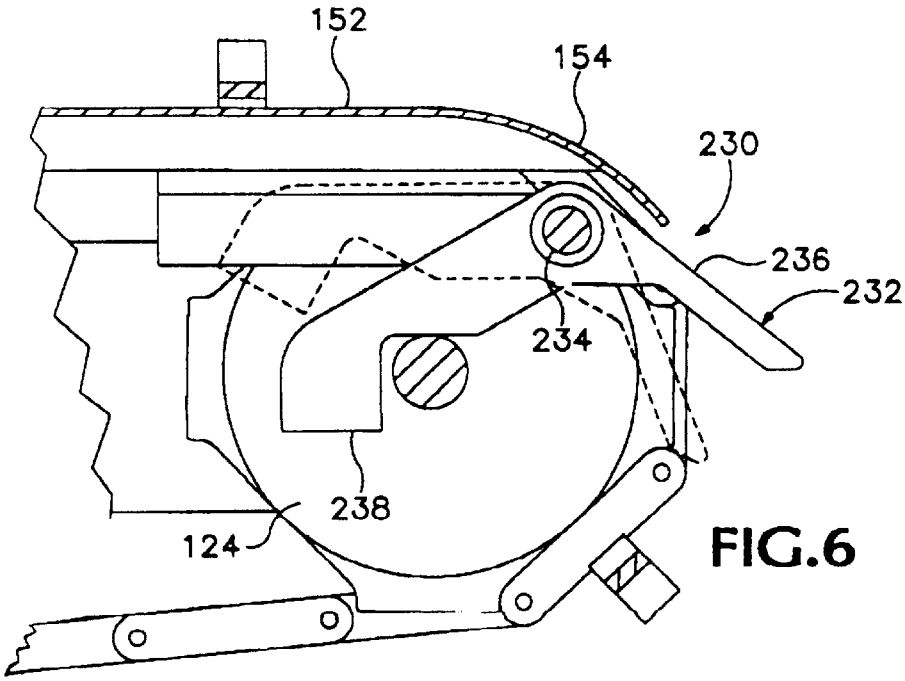
FIG. 6 is a sectional view through the downstream end of the profiling section along line 6—6 in FIG. 2.
Figure 7:
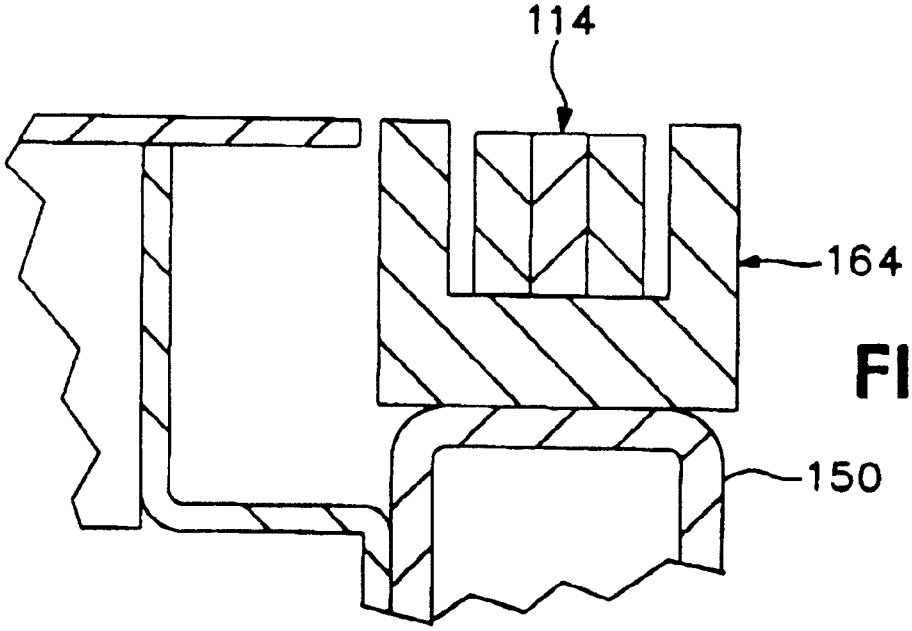
FIG. 7 is a partial section view of through a support section of a track on the profiling section along line 7—7 in FIG. 2.
Figure 8:
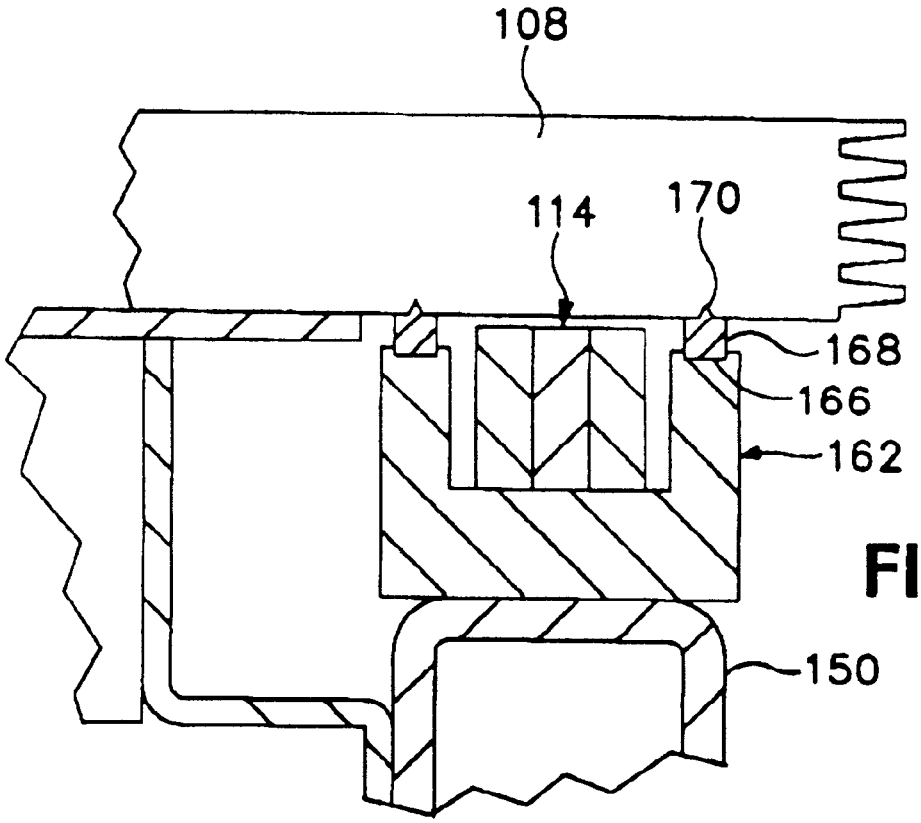
FIG. 8 is a partial section view of through a support section of a track on the profiling section along line 8—8 in FIG. 2.
Figure 9:
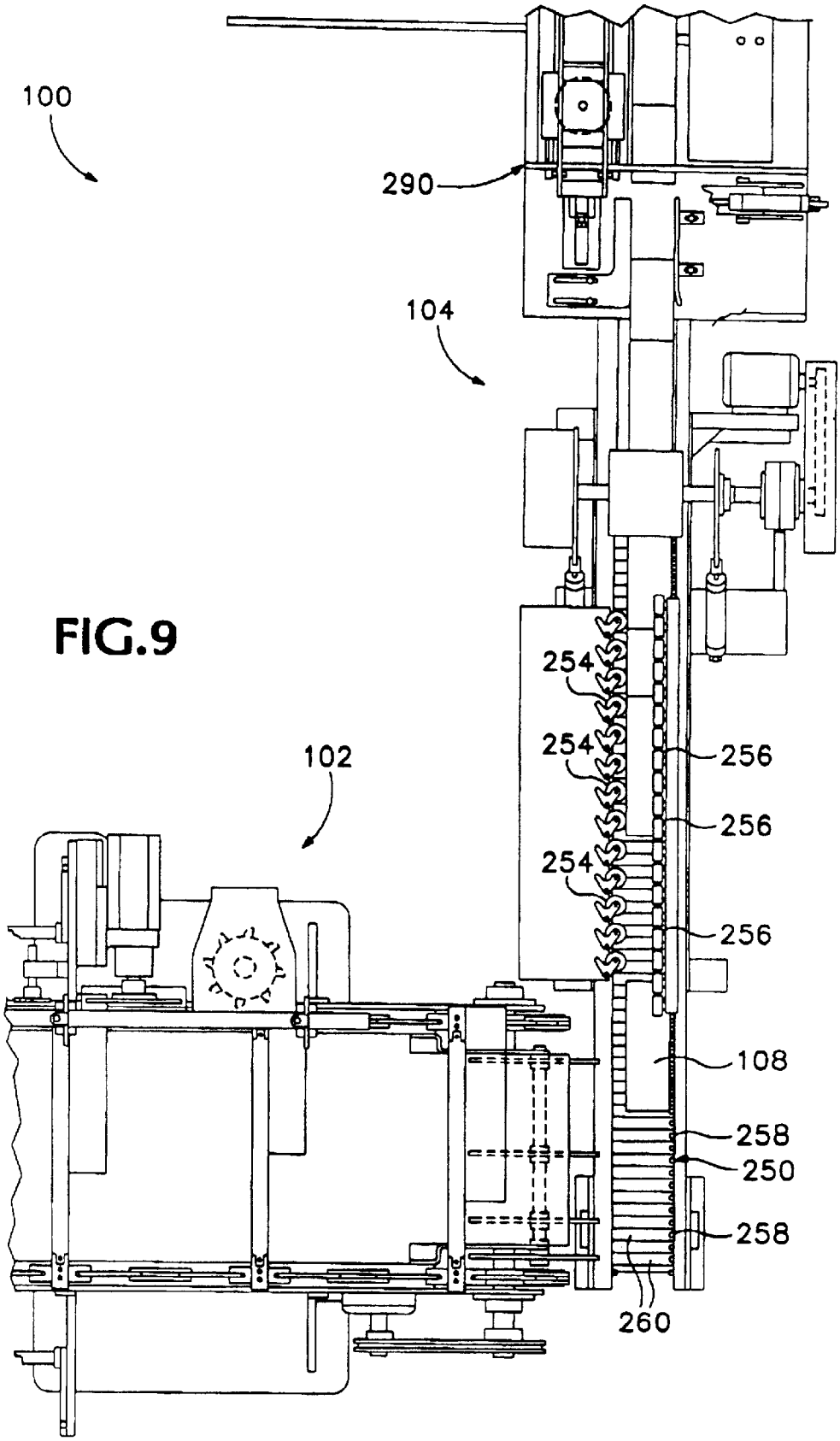
FIG. 9 is a plan view of an assembly conveyor forming part of the finger jointer.
Figure 10:
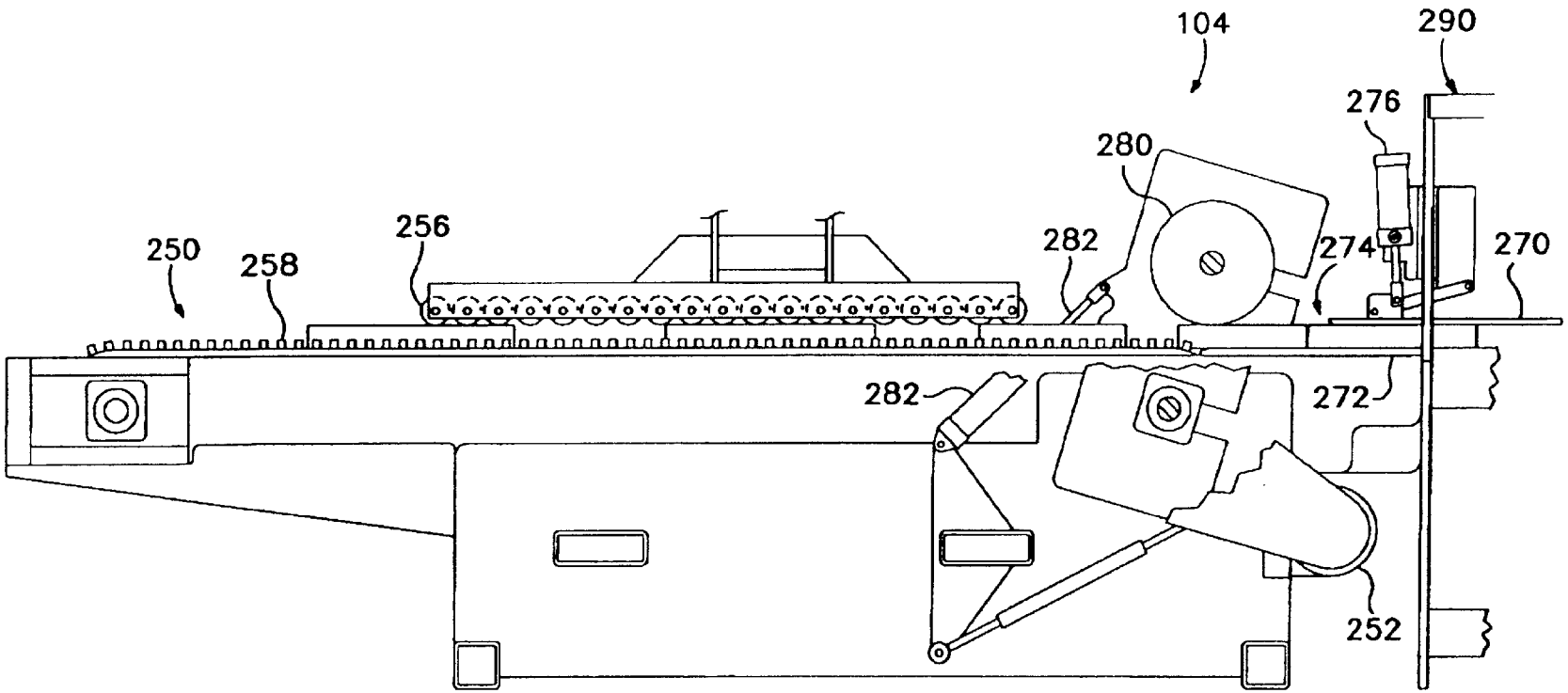
FIG. 10 is a elevation view of the assembly conveyor of FIG. 9.
Figure 11:
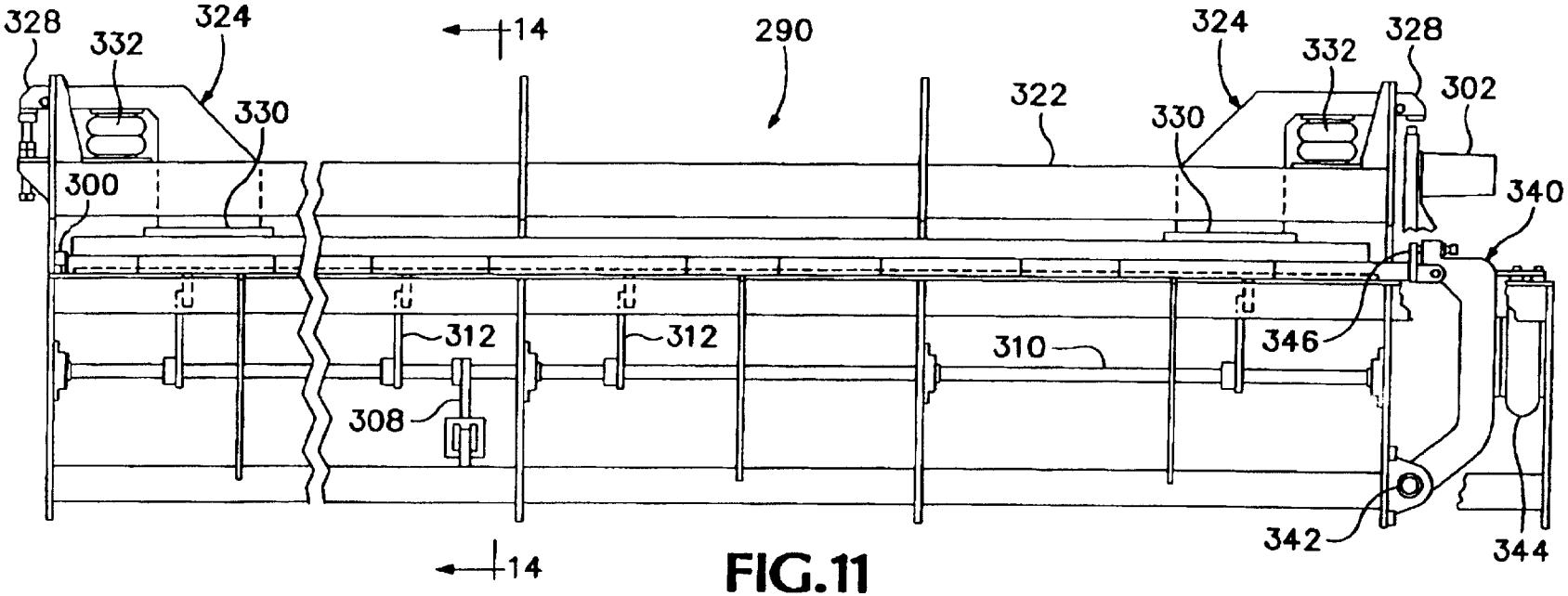
FIG. 11 is an elevation view of a press forming part of the finger jointer.
Figure 12:
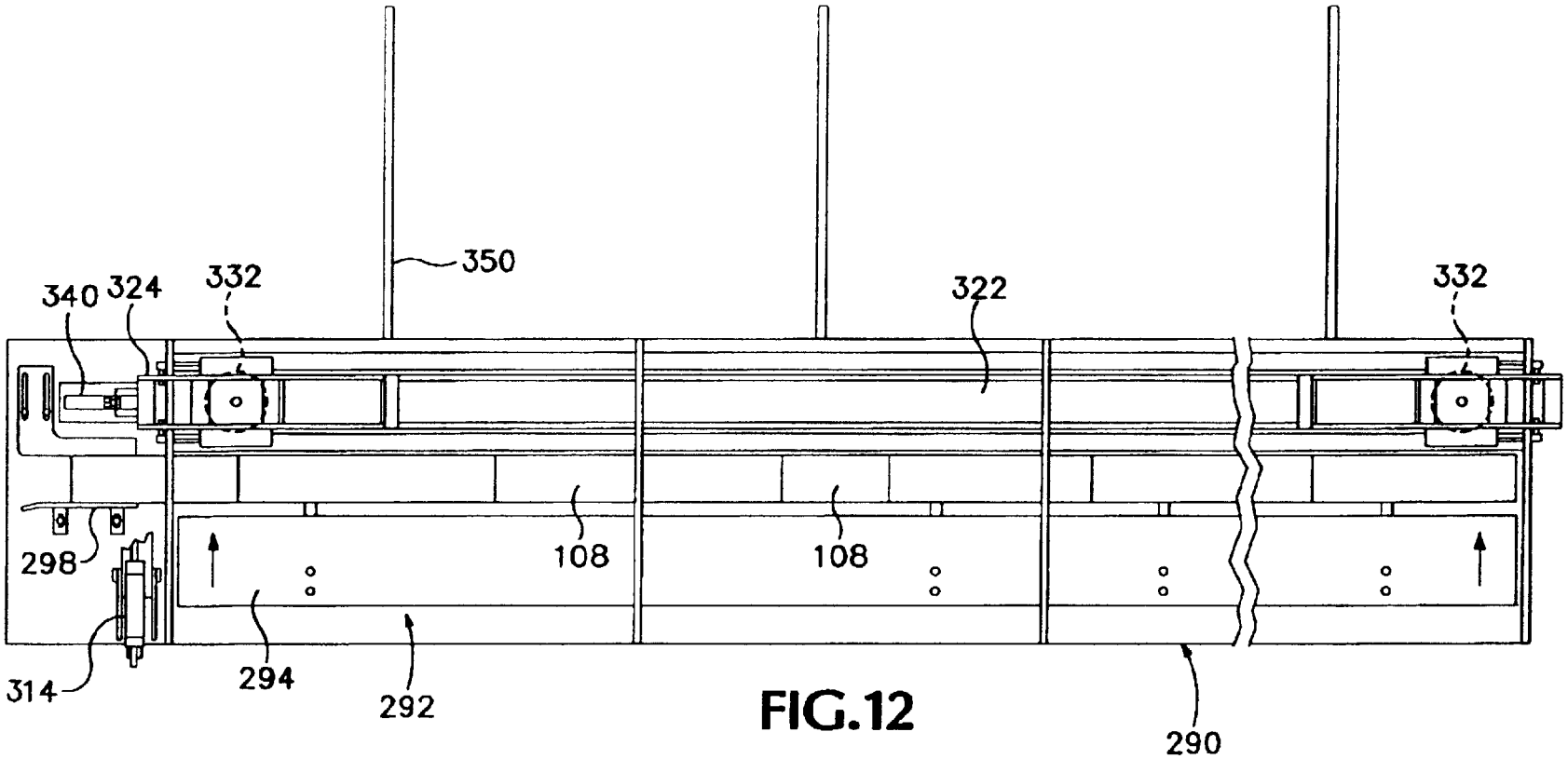
FIG. 12 is a plan view of the press of FIG. 11.
Figure 13:
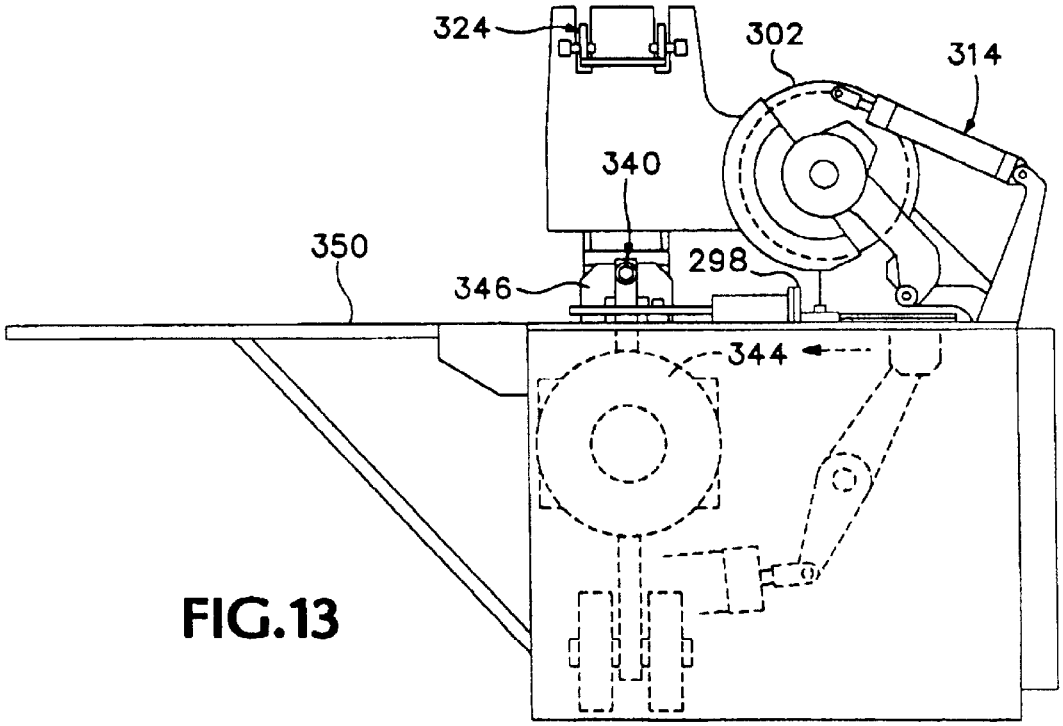
FIG. 13 is an end view of the press of FIG. 11.
Figure 14:
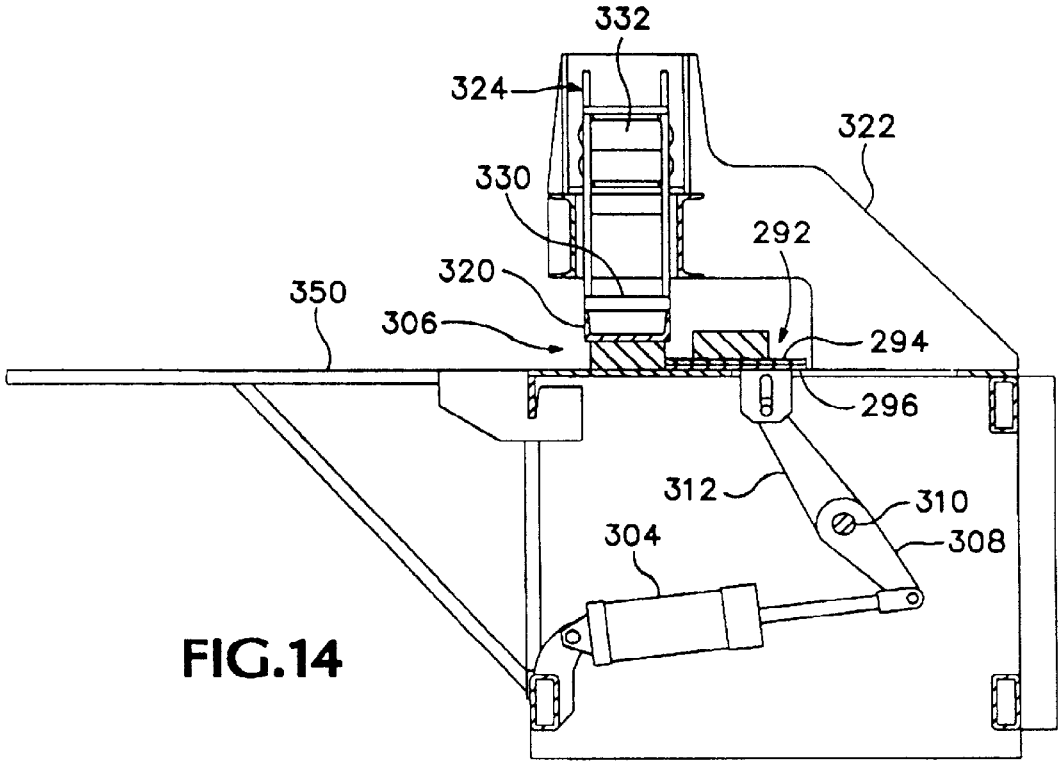
FIG. 14 is a section view of the press along line 14—14 in FIG. 11.

The steps in producing clear lumber according to the present invention are illustrated in FIG. 1. A long, low grade piece of lumber 10, including a number of defects, such as knots 12 and crack 14, is cut along lines 16 to create a number of short clear blocks 18. A pattern of wedges or fingers 20, known as a finger joint, is milled into the ends of each block 18 and glue is applied to the milled ends. Blocks 18 are then pressed together to form a single long board 22, free of any defects. In practice, blocks 18 may be cut from low grade lumber or they may be recovered remnants or scraps from some other process. It should be noted that the typical finger joint is asymmetric on the blocks and leaves a rabbet 24 along one surface of the block.

Finger jointing machine 100 includes a profiling section 102, shown in FIGS. 2–8, in which the finger joint profile is milled into the ends of wood blocks to be joined and a pressing section 104, shown in FIGS. 9–14, in which the blocks are pressed together. Profiling section 102 has an upstream end 106 where blocks 108 are loaded onto a feed conveyor 110 to be conveyed to a downstream end 112 and transferred to pressing section 104 for assembly. See FIG. 2.

Two lateral lug chains 114, 116 form sides edges of feed conveyor 110 and a series of push bars 118 extend between the lug chains. Lug chains 114, 116 extend around an upstream end roll 120 and continue to and around a downstream end roll 122. Each end roll includes a sprocket 124 disposed at the edge to carry the lug chain. See FIG. 5. A gear motor 126, shown in Fig. B, drives downstream end roll 122, which drives the lug chains and therefore the entire feed conveyor. The gear motor may be single speed or adjustable to provide additional flexibility of throughput. It should be noted that the relative rotational orientation of the sprockets on the downstream end roll can be adjusted to establish the correct phase alignment between the two lug chains to thereby keep the push bars perpendicular to the direction of travel of the feed conveyor. The push bars may be formed of metal, plastic, such as ultra-high molecular weight polyethylene (UHMW), or some combination thereof.

Each lug chain is formed from two or three different lug types, including lug links 130. Each end of lug links 130 includes a clevis 132 for receiving an end 134 of a blade-like connecting link 136, as shown in Fig. C. In the embodiment shown, a dummy link 138 is disposed between every other pair of connecting links 136. The links are preferably held together by a pin 148 pressed into the holes in the ends of the links. It is also possible to use a bolt, although a friction pin is preferred due to the simplicity and economy. Each lug link 130 includes a lug mounting surface 140 where a lug 142 is bolted. The lug includes a lateral arm 144 to which one end of one of the push bars is mounted. Each lug further includes a front face 146 which pushes against blocks to be milled.

If it is necessary to increase the production of the finger jointing machine, it is possible to replace the dummy links with lug links to provide twice as many locations to deposit blocks, thereby doubling throughput. Because the lug links must be more precisely machined and require more complex machining than the dummy links and the connecting links, the lug links are considerably more expensive. Due to the number and cost of the lug links, the lug chains can represent as substantial portion of the cost of the entire machine. Thus, it is generally preferable to provide only the number of lug links necessary to achieve the desired production.

The feed conveyor is supported by a frame 150 which holds end rolls 120, 122. The frame also supports a sheet metal pan 152 which extends beneath the upper flight of the feed conveyor longitudinally between the end rolls and laterally between the lug chains. The pan provides a support surface for blocks to be placed upon when the finger jointer is loaded, and provides a surface for the blocks to slide on as they are carried through the profiling section by the feed conveyor. Blocks are initially loaded on to the pan in front of an oncoming lug/push bar, with one end of the block being aligned just past lug chain 116. The block is then caught by the lug/push bar and carried forward for milling. A fence 156 shifts the blocks into positioned along the push bar so that the ends are uniformly positioned for subsequent operations. See Fig. A. As shown in Fig. D, pan 152 has a downwardly curving downstream end 154 to support blocks as they make the transition to the pressing section, as will be described below.

Frame 150 further supports lug chain tracks 160 at each side of the feed conveyor to guide and support the lug chains. Each track includes a milling section 162 and a support section 164, as illustrated in detail in Figs. H and G, respectively. The milling section guides the lug chain and provides a precision reference surface for the blocks to ride on during the actual milling operations. In the preferred embodiment, the milling section is machined out of steel and includes notched upper edges 166 to receive an insert 168. Sharp raised ribs 170 are formed along the length of the inserts. See Fig. H. Blocks are pressed down against the milling section by pneumatically-actuated hold-downs 172, seen best in Fig. B, in preparation for profiling. The hold-downs include a slick stainless steel slide plate 174 positioned beneath a section of hose 176 which can be inflated to urge the plate against the blocks. The downward pressure of the hold-down and the sharp ribs in the inserts work together to keep the blocks from shifting during profiling.

In contrast to the milling section, the support section does not need to be precisely milled because the support section is not used as a reference to position cutting operations. In the described embodiment, the support sections are milled from UHMW. This material provides sufficient durability for the support sections and is economical and easy to machine.

Profiling section 102 includes right and left shaper stations 180, 182 disposed adjacent respective milling sections, each shaper station being configured to cut the finger joint profile into one end of the blocks. See Figs. A and B. Although only right (or upstream) shaper station 180 will be described in detail, it should be understood that the two sections are similar in construction.

Starting from the upstream end, shaper station 180 includes a passive scoring knife 184 which cuts a shallow slice along the top side of blocks passing underneath. The scoring knife includes a circular blade 186, similar to a pizza knife, which is carried by a mounting structure 188. The mounting structure is adjustable in height to accommodate blocks of varying thickness and holds the blade in position to engage the top of the block, so that the blade rolls over the top side of the block making a shallow cut. It should be noted that the scoring knife in the disclosed embodiment is passive in the sense that it is not self-powered, as with a motor. This is beneficial due to the savings provided by eliminating the need for a motor.

After blocks pass underneath the scoring knife, the ends are trimmed by a trim saw 190. Trim saw 190 includes a saw blade 192 driven by a motor 194 to trim the end of blocks as they pass. The motor is mounted to a horizontal slide 196 to allow the horizontal position of the trim saw to be adjusted. Trimming insures that the ends of the blocks are square and uniformly positioned for the subsequent milling step. With the end squared up by the trim saw, blocks are carried forward through a shaper 200, where the finger joint profile is cut into the end. The shaper includes a cutting head 202, with a plurality of cutters 208 disposed around the perimeter. The head is rotated by motor 204 which is mounted on a carriage 206 to allow the motor/cutter head assembly to be adjusted up and down to properly position the finger joint profile on the end of the blocks.

As the blocks are passing through shaper station 180, they are right-aligned so that the right end of the blocks is aligned along the right edge of the feed conveyor. Once the finger joint profile is formed in the first end of the blocks, the blocks are shifted over to a left aligned position by a transfer conveyor 210. Transfer conveyor 210 is positioned over the feed conveyor between shaper stations 180, 182 and is oriented transverse to the feed conveyor. As shown in Fig. E, the transfer conveyor includes a flexible belt 212 onto which are fastened a number of brushes 214. The belt runs on a pair of end rolls 216, one of which is preferably powered by a variable speed drive (not shown).

The position of the transfer conveyor along the feed conveyor is adjustable on rails 218, which are in turn mounted to the frame through a height-adjusting mechanism 220, to accommodate variations in block size and feed rate. See Fig. E. As blocks are carried beneath the transfer conveyor, the brushes engage the upper surfaces of the blocks to drag the blocks across the push bar to a stop 224 on the left side of the feed conveyor. Once the blocks reach the stop, the brushes simply slide over the surface of the blocks until they are carried past the transfer conveyor. After shifting, the finger joint profile is milled on the left ends of the blocks by shaper station 182 and glue is applied at a gluing station 222.

Blocks leaving shaper station 182 continue to the downstream end of the profiling section where they are pushed off the end of pan 152 by the feed conveyor. A ramp mechanism 230 is disposed adjacent the downstream end roll to receive blocks as they come off the feed conveyor and transfer them to the pressing section. The ramp mechanism includes a plurality of ramp arms 232 pivotally mounted to a crossbar 234 positioned between the sprockets of the end rolls. See Fig. D. Each ramp arm includes a ramp portion 236 and a counterweight portion 238. The counterweight portion biases the ramp arm to a loading configuration where the ramp portion projects through the path of the feed conveyor to receive blocks as they to slide down off the end roll. The blocks are supported by and slide down the ramp portions until they are deposited on the upstream end of the pressing section. As a block slides off the ramp portions, the push bar behind the block continues around the end roll and pushes down on the ramp portions to swing them out of the way to a retracted position so that the push bar can pass, as shown by the dotted lines in Fig. D. The counterweights then bias the ramp portions to swing back to the loading configuration.

Blocks coming off the feed conveyor are deposited on an assembly conveyor 250, shown in Figs. I and J, which forms an upstream end of the pressing section. The assembly conveyor is driven by a motor 252 and moves the blocks downstream through a series of horizontal and vertical rollers 254, 256, respectively. Horizontal rollers 254 push the blocks over against stops 258 formed on links 260 of conveyor 250 to insure horizontal alignment of the blocks. By placing the stops on the links themselves, a moving fence is created which eliminates the drag associated with a fixed fence or stop which the blocks would slide against. The vertical rollers press down on the blocks to insure that the ends are aligned vertically as the blocks are crowded together. The rollers in each both the horizontal and vertical sections are individually suspended to accommodate minor variations in block size and are adjustable in position to allow for various nominal block sizes.

A retard shoe 270 positioned over a steel plate 272 disposed at the downstream end of the assembly conveyor creates a restriction zone 274. The retard shoe is pushed against the top of the blocks by a pneumatic cylinder 276. The drag created on the blocks pinched between the retard shoe and the steel plate is preferably adjusted to be sufficient to stop the flow of blocks off the assembly conveyor. The resulting backup causes blocks coming onto the conveyor to be pushed against the blocks in front of them in the zone of the rollers as the leading blocks are stalled by the restriction zone.

An articulated urethane drive roll 280 is disposed over the assembly conveyor at the downstream end and is driven by a take off from the assembly conveyor. The articulated roller is shiftable by a pneumatic cylinder 282 from a standby configuration in which it does not contact the blocks to a drive configuration in which it is pushed down against the upper surface of the blocks. See Fig. I. When the drive roll is pushed against the blocks it provides enough force to push the blocks through the restriction zone. Selective engagement of the drive roll by shifting from the standby configuration to the drive configuration can therefore be used to control the flow of blocks.

The compression created between the drive roll and the restriction zone pushes the blocks partially together in preparation for the subsequent pressing operation, which will be described below. It should be noted that the drive roll is driven at a slower speed than the assembly conveyor so that, even when the drive roll is engaged to move blocks forward, a compressive pressure is maintained on the line of blocks by the assembly conveyor to keep the blocks pushed together.

The stream of partially pressed together blocks is fed into a press 290, shown in Figs. K–N. The blocks are received on an elongate moveable tray 292 which runs most of length of the press. The tray is formed by a steel top plate 294 on a UHMW slide plate 296. See Fig. M. The steel top plate provides a relatively low friction surface for the stream of blocks to ride on as they are feed into the press and the slide plate provides a durable surface to slide against the underlying frame when the tray is moved, as will be described below. A guide fence 298 runs guides the blocks entering the press as they are slid into position.

The stream of blocks is fed into the press until it reaches a downstream stop 300, where a sensor detects the blocks, resulting in triggering of the drive wheel to shift to the standby position. A cutoff saw 302, shown in Fig. L, is actuated via cylinder 314, to cut the stream of blocks at the upstream end of the tray. A pneumatic cylinder 304 is cycled to rapidly withdraw the tray from underneath the trimmed-to-length series of blocks and then push the blocks to a clamping station 306 as the tray returns to the loading position. The pneumatic cylinder acts through a lever arm 308 connected to a torque rod 310 running the length of the press. A series of cranks 312 disposed along the torque rod are connected to the tray to convert the rotation of the torsion rod to translation of the tray.

Clamping station 306 includes an overhead hold down beam 320 which is connected to a press frame 322 by cantilever arms 324. Each arm has a fixed end 328 which is pivotally mounted to the frame and a beam end 330 connected to the beam. Pneumatic bags 332 are disposed between the ends to selectively lift the beam. The bags are inflated to lift the beam to allow the tray to push the series of blocks beneath the beam and deflated to allow the beam to settle down onto the top of the blocks. The beam is held against the blocks by gravity, which provides sufficient pressure to stabilize the blocks for the subsequent pressing operation.

Once in place under the hold down, the blocks are pressed together by an anvil 340 which is mounted to the frame at a pivot 342 and actuated by a pneumatic bag 344 to press a face 346 of the anvil against the end of the blocks. The blocks are pressed for at least several seconds. As one series of blocks is being pressed, the next series of blocks is being fed into the press on the tray. When the next series of blocks is loaded, the anvil is released, the hold down beam is raised and the tray is cycled to push the next series of blocks under the hold down, thereby pushing the just-pressed series of blocks out of the clamping station. The pressed series of blocks are accumulated on a plurality of rails 350 extending transverse to the clamping station.

While the invention has been disclosed in its preferred form, it is to be understood that the specific embodiment thereof as disclosed and illustrated herein is not to be considered in a limiting sense as numerous variations are possible and that no single feature, function or property of the preferred embodiment is essential. The invention is to be defined only by the scope of the issued claims.

I claim:

1. An automated finger jointer comprising:

a frame;

a first finger joint cutting head mounted to the frame; and a first lug chain mounted to the frame and configured to carry blocks of wood past the first finger joint cutting head, the lug chain including a set of lug links adapted to carry lugs and a set of connecting links disposed between, the lug links being configured to connect to the connecting links but not to each other.

2. The automated finger jointer of claim 1, further including a second finger joint cutting head and a second lug chain disposed parallel to and spaced apart from the first lug chain and a plurality of push bars extending between the lug links on the first and second lug chains, the second lug chain being configured to carry blocks of wood past the second finger joint cutting head.

3. The automated finger jointer of claim 2, further including a transfer conveyor disposed generally transverse to and overlying the lug chains between the first and second finger joint cutting heads to shift blocks of wood from a position with a first end aligned adjacent the first lug chain to a position with a second end aligned adjacent the second lug chain.

4. The automated finger jointer of claim 2, wherein the lug chains extend around a downstream end roll and the push bars define a feed path as they move with the lug chains around the end roll, the automated finger jointer further including a ramp mechanism disposed adjacent the downstream end roll and having a loading configuration in which a block receiving portion of the ramp mechanism is disposed in the feed path and is adapted to receive blocks of wood being conveyed in front of the push bars, the ramp mechanism further having a retracted configuration in which the block receiving portion is disposed out of the feed path so that the push bars may pass after the blocks of wood are received by the ramp mechanism.

5. The automated finger jointer of claim 1, wherein the lug chain further includes at least one dummy link disposed between two connecting links, where the dummy link is not adapted to carry a lug.

6. The automated finger jointer of claim 1, wherein the lug chain includes alternating dummy links and lug links separated by connecting links.

7. The automated finger jointer of claim 1, further comprising a track mounted to the frame and positioned to support the lug chain, the track having at least two sections including a milling section disposed adjacent where the lug chain goes past the finger joint cutting head and a support section disposed away from the finger joint cutting head, where the milling section is made of a different material than the support section.

8. The automated finger jointer of claim 7, wherein the milling section is machined to a greater precision than the support section.

9. The automated finger jointer of claim 1, further including a passive knife system disposed upstream of the first finger joint cutting head to make a shallow cut along a first side of the blocks of wood.

10. An automated finger jointer comprising:

a frame;

a feed conveyor mounted to the frame and configured to convey blocks of wood in a feed direction;

first and second opposed finger joint cutting heads mounted to the frame spaced apart along the feed conveyor; and a transfer conveyor having a feed direction disposed generally transverse to the feed conveyor, the transfer conveyor being disposed overlying the feed conveyor between the first and second finger joint cutting heads to shift blocks of wood from a position with a first end aligned adjacent one side of the feed conveyor to a position with a second end aligned adjacent a second side of the feed conveyor.

11. The automated finger jointer of claim 10, wherein the transfer conveyor is adjustably mounted to the frame to be positioned over a range of locations between the first and second finger joint cutting heads.

12. The automated finger jointer of claim 10, wherein the transfer conveyor includes a belt and a plurality of brushes attached to the belt to contact the blocks of wood.

13. An automated finger jointer comprising:

a frame;

a feed conveyor mounted to the frame and configured to convey blocks of wood in a feed direction;

a finger joint cutting head disposed on the frame adjacent the feed conveyor to cut a finger joint profile in a first end of blocks of wood conveyed by the feed conveyor, the finger joint profile leaving a rabbet along the intersection of the first end and a side of the block of wood; and a passive knife system disposed upstream of the finger joint cutting head to slice fibers along the first side of the wood block adjacent the rabbet.

14. The automated finger jointer of claim 13, wherein the passive knife system includes a rotatable circular blade positioned to engage the first side of the wood block adjacent the rabbet, the block causing the blade to rotate as it passes the blade.

15. An automated finger jointer comprising:

a frame;

a finger joint cutting head disposed on the frame; and a lug conveyor mounted to the frame and configured to convey blocks of wood from an upstream position on the frame past the finger joint cutting head to a downstream position on the frame, where the lug conveyor is supported by a track at least partially along its length between the upstream and downstream positions, the track including a first section disposed adjacent the finger joint cutting head and a second section disposed away from the finger joint cutting head, the first section being formed of a different material than the second section.

16. The automated finger jointing system of claim 15, wherein the first section is made of metal.

17. The automated finger jointing system of claim 15, wherein the second section is made of plastic.

* * * * *